US008905115B2

(12) United States Patent
Wu

(10) Patent No.: US 8,905,115 B2
(45) **Date of Patent: *Dec. 9, 2014**

(54) BLIND CORD WINDER INTEGRATING WITH STOPPING CONTROL

(76) Inventor: Wen-Yu Wu, Kaohsiung (TW)

( * ) Notice: Subject to any disclaimer, the term of this patent is extended or adjusted under 35 U.S.C. 154(b) by 209 days.

This patent is subject to a terminal disclaimer.

(21) Appl. No.: 13/599,327

(22) Filed: Aug. 30, 2012

(65) Prior Publication Data

US 2014/0061354 A1 Mar. 6, 2014

(51) Int. Cl.
*E06B 9/30* (2006.01)

(52) U.S. Cl.
USPC ..... 160/170; 160/168.1 R; 160/299; 160/168.1 P; 160/172 R

(58) Field of Classification Search
USPC ..... 160/170, 171, 168.1 R, 168.1 P, 178.2, 160/84.04, 84.01, 298, 299
See application file for complete search history.

(56) References Cited

U.S. PATENT DOCUMENTS 5,228,491 A * 7/1993 Rude et al. ..... 160/171
6,029,734 A * 2/2000 Wang et al. ..... 160/170
6,330,899 B1 * 12/2001 Ciuca et al. ..... 160/170
7,311,133 B2 * 12/2007 Anderson et al. ..... 160/170
8,342,309 B2 * 1/2013 Takagi ..... 192/223.4
8,522,852 B2 * 9/2013 Yu et al. ..... 160/84.05
8,708,023 B2 * 4/2014 Wu ..... 160/170
8,708,024 B2 * 4/2014 Toti ..... 160/170
2007/0261798 A1 * 11/2007 Hung et al. ..... 160/170
2008/0128097 A1 * 6/2008 Yu et al. ..... 160/170
2012/0298317 A1 * 11/2012 Huang ..... 160/170
2013/0248125 A1 * 9/2013 Lin ..... 160/84.05

* cited by examiner

*Primary Examiner* — Katherine Mitchell
*Assistant Examiner* — Johnnie A Shablack
(74) *Attorney, Agent, or Firm* — Muncy, Geissler, Olds & Lowe, P.C.

(57) ABSTRACT

Disclosed is a blind cord winder integrating with stopping control to allow open/close operation of the cordless blind to lift or lower the cordless blind at any positions according to user's needs. The winder primarily comprises a spool installed inside a first compartment, a force-feedback mechanism, and a braking cushion mechanism installed inside a second compartment where the force-feedback mechanism is installed in a shaft cavity of the first compartment. The force-feedback mechanism includes a shaft sleeve and a volute spring. The braking cushion mechanism includes a friction ring, a friction spring, and a trigger sleeve. The friction ring is immovably installed inside the second compartment. The friction spring is tightly plugged into the friction ring and has an extrusion end for the trigger sleeve to trigger friction variation in a single directional rotation of the trigger sleeve.

15 Claims, 8 Drawing Sheets

BLIND CORD WINDER INTEGRATING WITH STOPPING CONTROL

FIELD OF THE INVENTION

The present invention relates to a control unit for an open/close device built-in or movably installed at window openings of a building and more specifically to a blind cord winder integrating with stopping control.

BACKGROUND OF THE INVENTION

Blinds of early days were controlled by blind cords where a switching controller was installed at one end of the track located on top of a blind. A bead chain or a blind cord was hanging down from the switching controller to lift or lower the blind by pulling the bead chain. However, accidents of strangling small children by the bead chains have been occurred, therefore, blinds with bead chains have been forbidden in many countries. Hence, cordless blinds become household necessities. Even though there are many different designs of cordless blinds, their switching operation is not as convenient as blinds with cords.

The conventional cordless blinds hide the blind cords inside the blind with an exposed spool to collect the blind cords and are operated by an extra installed stopping control device to fully open/close the cordless blinds. However, the cordless blinds can not be stopped at any position according to user needs. Furthermore, the stopping control device of a cordless blind is customized and is designed and manufactured according to the weight and dimension of a cordless blind. If a stopping control device does not match with the dimension and weight of a cordless blind, the cordless blind either suddenly drops to hurt someone below or completely and automatically lifts without fully close function. Moreover, the exposed spool is easily contaminated when used in years where the blind cords can not easily be rolled up. It is also time-consuming to install cordless blinds with exposed spools.

SUMMARY OF THE INVENTION

The main purpose of the present invention is to provide a blind cord winder integrating with stopping control to minimize the blind stopping component for easy component integration and installation and to enable users to stop the cordless blind at any position during lifting or lowering the cordless blind.

Another purpose of the present invention is to provide a blind cord winder integrating with stopping control to avoid exposure of blind cords from contamination, to avoid sudden dropping of the cordless blind to hurt someone below, and to further reduce lifting force to open a cordless blind.

According to the present invention, a blind cord winder integrating with stopping control is disclosed where an envelope of the blind cord winder consists of a first compartment and a second compartment jointed together. The blind winder comprises a spool, a force-feedback mechanism, and a braking cushion mechanism. The spool is installed inside the first compartment where one side of the first compartment has a shaft cavity. The force-feedback mechanism is installed inside the shaft cavity and the force-feedback mechanism includes a shaft sleeve and a volute spring. One end of the volute spring is connected to the shaft sleeve and the other end of the volute spring is fastened at the first compartment to provide a reposition elastic force for the shaft sleeve to return to the original position. The braking cushion mechanism is installed inside the second compartment and includes a friction ring, a friction spring, and a trigger sleeve where the friction ring has a wear-proof annular inwall and is immovably installed inside the second compartment. The friction spring is tightly plugged into the wear-proof annular inwall with an extruded end for the trigger sleeve to trigger friction variation in a single directional rotation of the trigger sleeve. Therefore, with the integration of the braking cushion mechanism, the force-feedback mechanism, and the spool as one single module, the cordless blind can easily be installed and can be stopped at any positions according to user's needs.

DETAILED DESCRIPTION OF THE INVENTION

With reference to the attached drawings, the present invention is described by means of the embodiment(s) below where the attached drawings are simplified for illustration purposes only to illustrate the structures or methods of the present invention by describing the relationships between the components and assembly in the present invention. Therefore, the components shown in the figures are not expressed with the actual numbers, actual shapes, actual dimensions, nor with the actual ratio. Some of the dimensions or dimension ratios have been enlarged or simplified to provide a better illustration. The actual numbers, actual shapes, or actual dimension ratios can be selectively designed and disposed and the detail component layouts may be more complicated.

Figure 1:
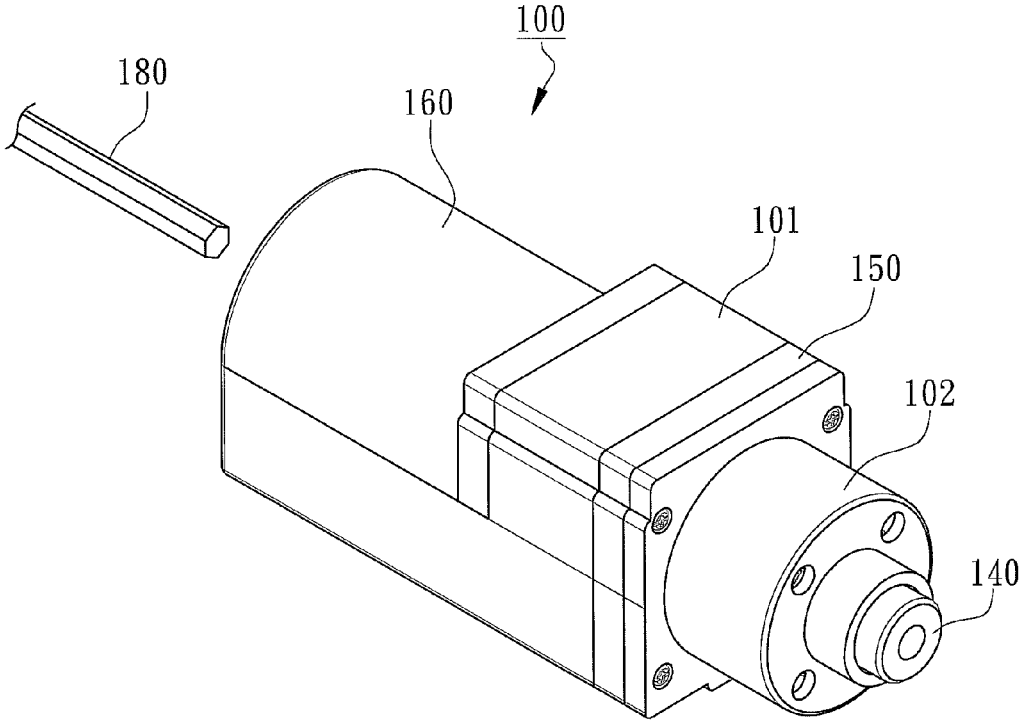
FIG. 1 is a three-dimensional view of a blind cord winder integrating with stopping control according to the preferred embodiment of the present invention.
Figure 2:
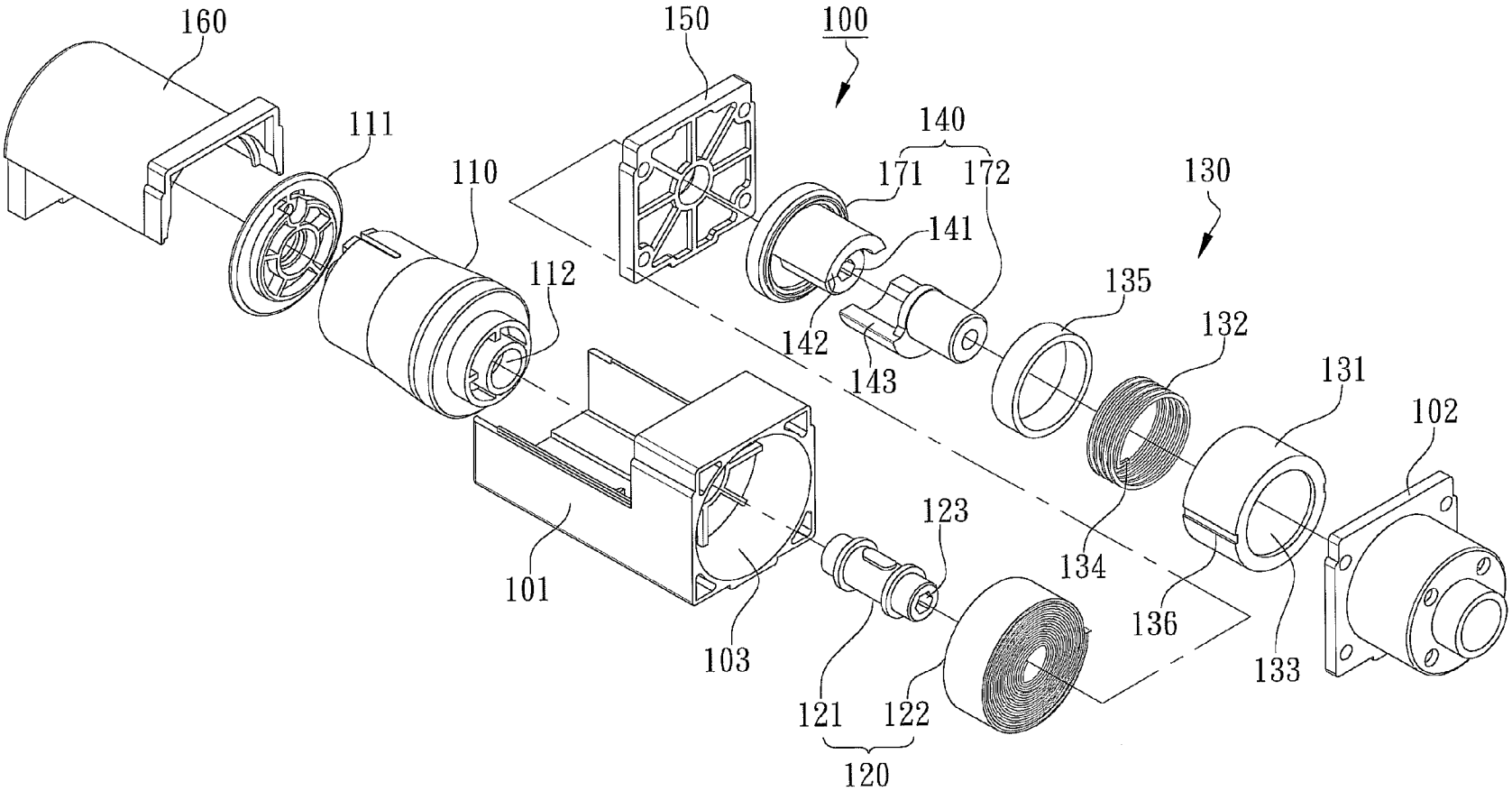
FIG. 2 is a three-dimensional component exploded view of the blind cord winder according to the preferred embodiment of the present invention.
Figure 3:
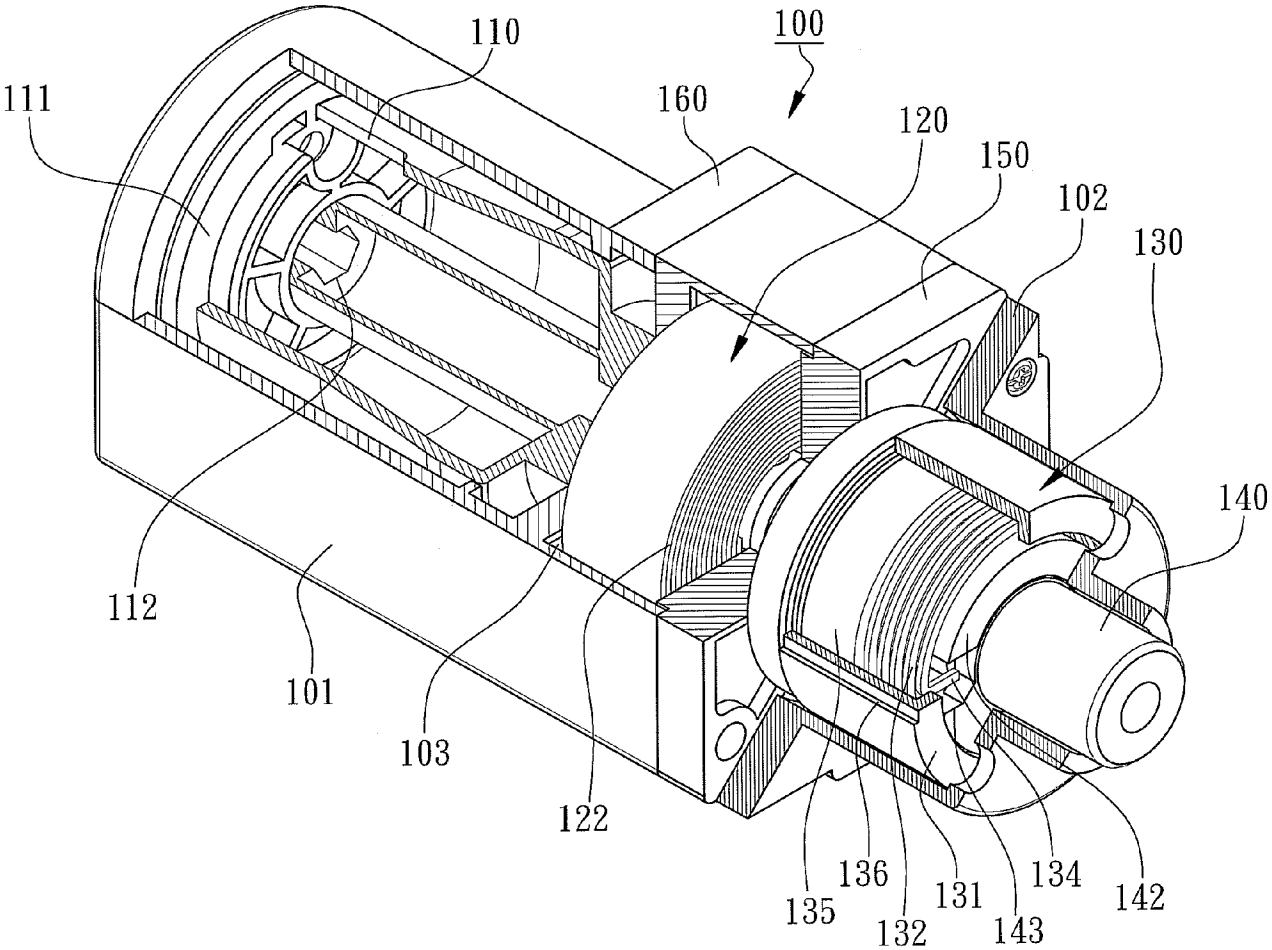
FIG. 3 is a partially three-dimensional cross-sectional view of the blind cord winder according to the preferred embodiment of the present invention.
Figure 4:
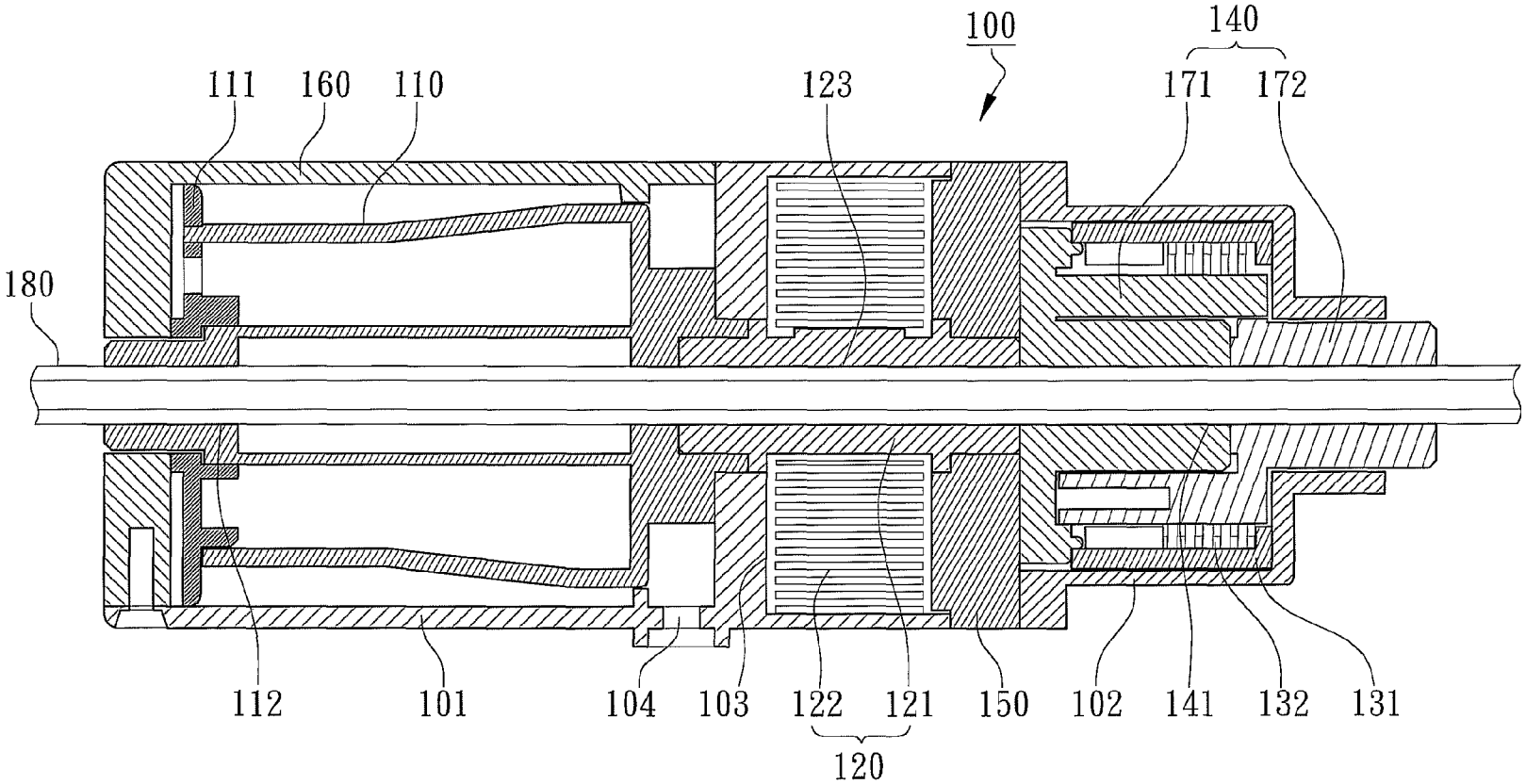
FIG. 4 is an axially cross-sectional view of the blind cord winder according to the preferred embodiment of the present invention.

According to the preferred embodiment of the present invention, a blind cord winder 100 integrating with stopping control is disclosed in FIG. 1 for a three-dimensional view, FIG. 2 for a three-dimensional component exploded view, FIG. 3 for a partially three-dimensional cross-sectional view, and FIG. 4 for an axially cross-sectional view. The blind cord winder 100 has an envelope consisting of a first compartment 101 and a second compartment 102 jointed together where the blind cord winder 100 comprises a spool 110, a force-feedback mechanism 120, and a braking cushion mechanism 130.

Figure 5:
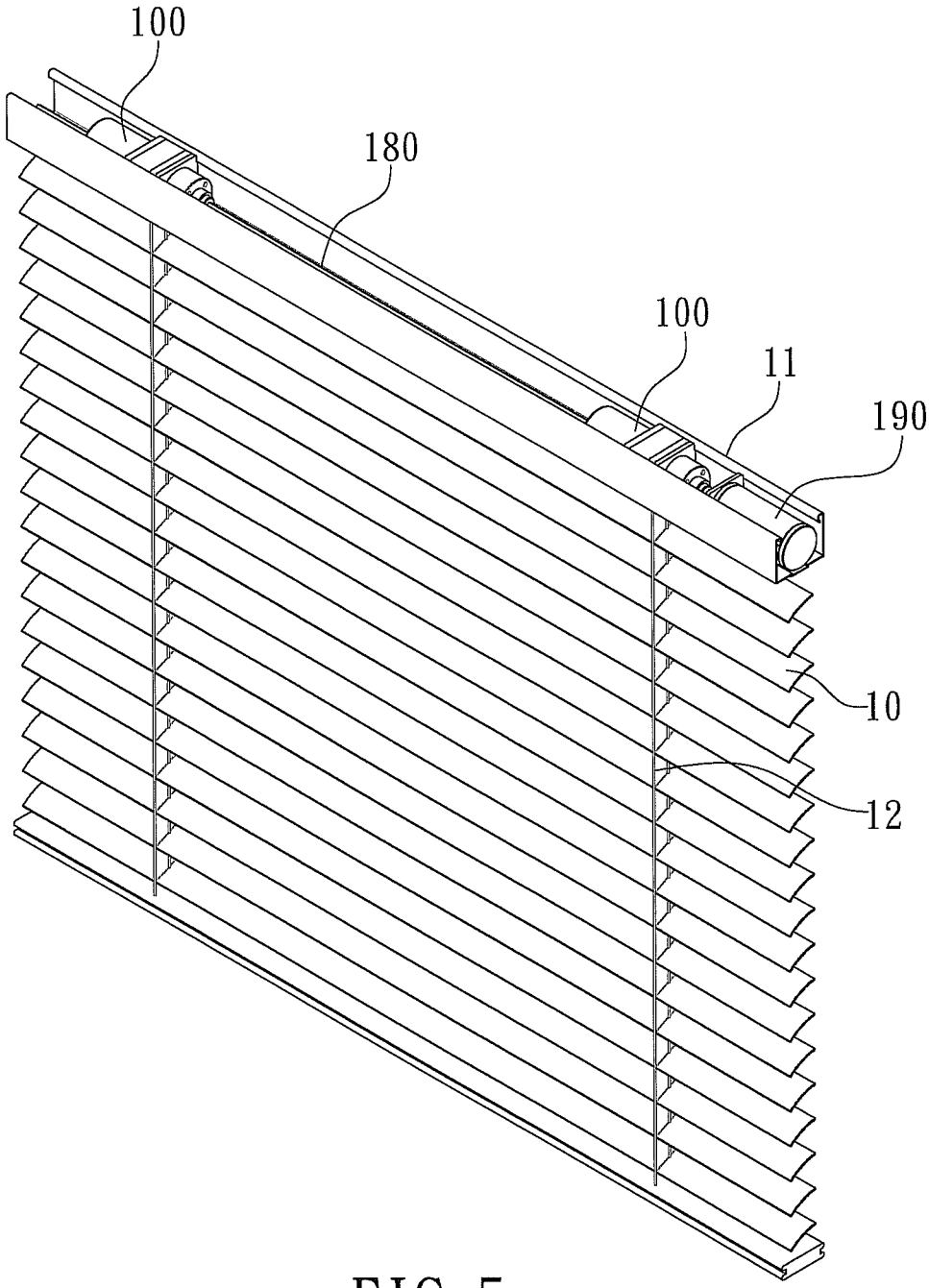
FIG. 5 is a three-dimensional view illustrating the blind cord winder installed in a cordless blind according to the preferred embodiment of the present invention.

The spool 110 is installed inside the first compartment 101 where the first compartment 101 has a shaft cavity 103 at one side. The spool 110 can rotate as the blind shaft 180 rotates to collect the blind cords 12 as shown in FIG. 5, for example the spool 110 has a shaft jointing hole 112 located at an axis of the spool 110 so that the blind shaft 180 can be penetrated through and rotated synchronously as shown in FIG. 4. Moreover, a blind cord guiding hole 104 is formed on the bottom of the first compartment 101 so that the blind cord 12 can be rolled up and released. The blind cord winder 100 further comprises a cover 160 which is buckled at the other end of the first compartment 101 corresponding to the shaft cavity 103 to keep the spool 110 inside the first compartment 101. Furthermore, a confining disc 111 is jointed at the other end of the spool 110 away from the blind cord guiding hole 104 to prevent the blind cord 112 from breaking away and keeping an effective rotation of the spool 110.

The force-feedback mechanism 120 is installed inside the shaft cavity 103 to provide a reposition elastic force to roll up the blind. The force-feedback mechanism 120 at least includes a shaft sleeve 121 and a volute spring 122 where one end of the volute spring 122 is connected to the shaft sleeve 121 and the other end of the volute spring 122 is fastened in the shaft cavity 103 of the first compartment 101 such as the shaft of the shaft sleeve 121 has a buckling part where the corresponding curved end of the volute spring 122 is buckling to the buckling part. On the other hand, a buckling space is reserved at one of the sides or the corners of the shaft cavity 103 of the first compartment 101 where the corresponding curved end of the volute spring 122 is buckling at the buckling space. The reposition elastic force provided by the volute spring 122 is able to rotate the shaft sleeve 121 to return to the original position. Preferably, the blind cord winder 100 further comprises a partition 150 buckling to one side of the first compartment 101 located between the first compartment 101 and the second compartment 102 to confine the shaft sleeve 121 and the volute spring 122 inside the shaft cavity 103. In the present embodiment, the partition 150 has a shaft hole with meshed supporting bars connected to the shaft hole.

The braking cushion mechanism 130 is installed inside the second compartment 102. The braking cushion mechanism 130 includes a friction ring 131, a friction spring 132, and a trigger sleeve 140. The friction ring 131 has a wear-proof annular inwall 133 and is immovably fastened inside the second compartment 102. At least an alignment fillister 136 is formed on an outer annular surface of the friction ring 131 and a corresponding alignment buckling strip is disposed in the second compartment 102 to firmly fasten the friction ring 131 inside the second compartment 102 to prevent the friction ring 131 from rotation. The friction spring 132 is tightly plugged into the wear-proof annular inwall 133 and has an extruded end 134 for the trigger sleeve 140 to trigger friction variation in a single directional rotation of the trigger sleeve 140 where variable frictions at different rotation directions would be generated between the friction spring 132 and the friction ring 131. The braking cushion mechanism 130 further includes a ring plug 135 inserted in an opening end of the wear-proof annular inwall 133 to prevent breaking away of the friction spring 132 and to allow part of the trigger sleeve 140 to penetrate through. Preferably, the second compartment 102 is jointed to the partition 150 to confine the trigger sleeve 140 inside the second compartment 102 without affecting the assembly of the force-feedback mechanism 120.

In the present embodiment, the shaft sleeve 121 has a first shaft jointing hole 123 and the trigger sleeve 140 has a second shaft jointing hole 141 where the first shaft jointing hole 123 and the second shaft jointing hole 141 are aligned in the same axis. The first shaft jointing hole 123 and the second shaft jointing hole 141 are non-circular holes such as a hexagon or a jointing hole with a single or a plurality of axial confining bars or a triangle, a tetragon, or non-circular trimmed annular holes. Therefore, the shaft sleeve 121 and the trigger sleeve 140 are able to individually assemble without connections and can rotate synchronously. The blind cord winder 100 further comprises a blind shaft 180 penetrating through the first shaft jointing hole 123 of the shaft sleeve 121 and the second shaft jointing hole 141 of the trigger sleeve 141 and even penetrating through the third shaft jointing hole 112 of the spool 110. As shown in FIG. 5, the clockwise and anti-clockwise rotations of the blind shaft 180 enable synchronously rolling up and releasing the blind cord 12 and further enable opening/closing the blind 10. Since the blind cord winder 100 is in fully penetrating status where the blind shaft 180 penetrates through the first compartment 101, the shaft cavity 103, and the second compartment 102. In a various embodiment, a driving motor 190 is disposed and connected to one end of the blind shaft 180 to achieve effort-saving to open/close the blind 10.

Figure 6:
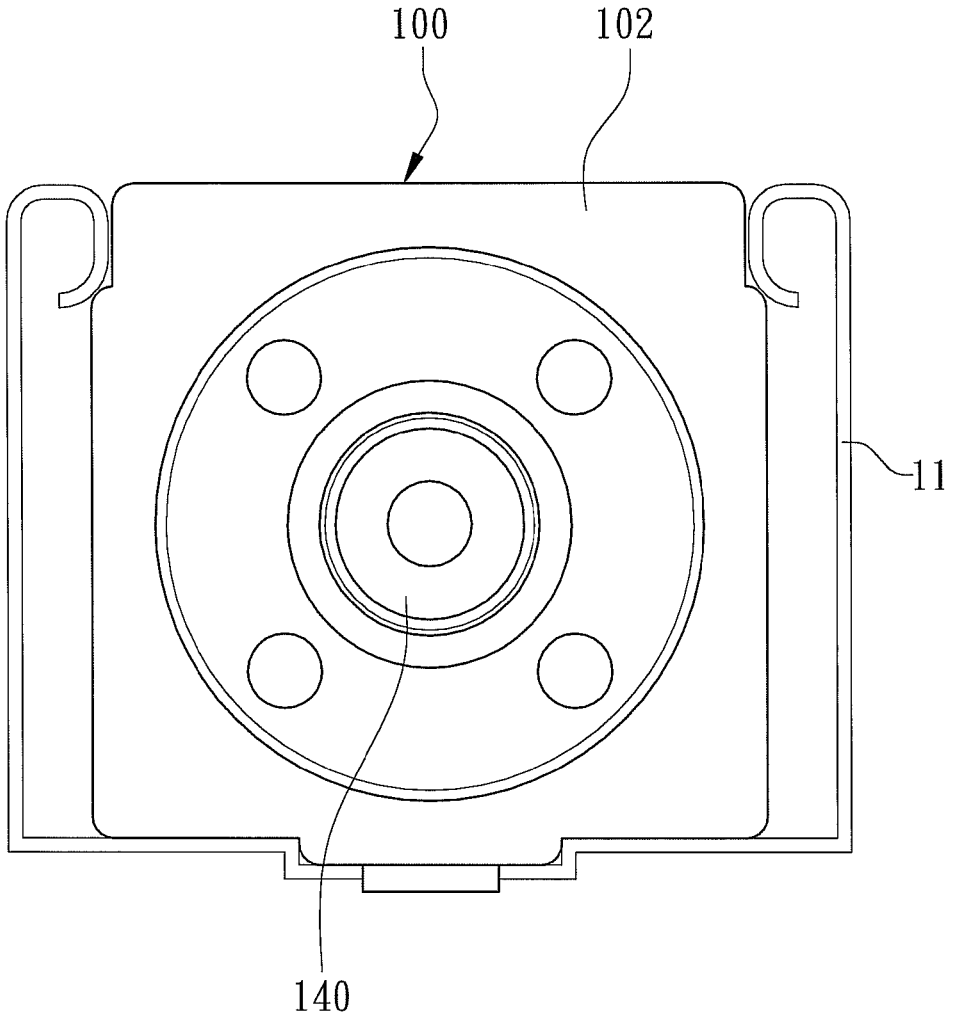
FIG. 6 is a radically side view illustrating the blind cord winder installed in a cordless blind according to the preferred embodiment of the present invention.

Therefore, the spool 110, the force-feedback mechanism 120, and the braking cushion mechanism 130 can be integrated in one module. As shown in FIG. 5 and FIG. 6, the blind cord winder 100 can be easily assembled in the blind 10 where the blind cord winder 100 can be fastened at the blind fixing bar 11 through buckling or screwing without extra installation procedure as installing the exposed spool of a conventional cordless blind. The blind cord 12 can be gradually rolled up by the spool 110 as the rotation of the blind shaft 180 and then the blind cord 12 is stored in the first compartment 101 where the blind 10 is in open status. When the blind cord 12 is gradually released by the spool 110 through the blind cord guiding hole 104, the blind 10 is in close status. Through the blind cord winder 100, the cordless blind 10 can be stopped at any positions during lifting or lowering the cordless blind 10 and the blind cord 12 is sealed up to prevent contamination.

Figure 7A:
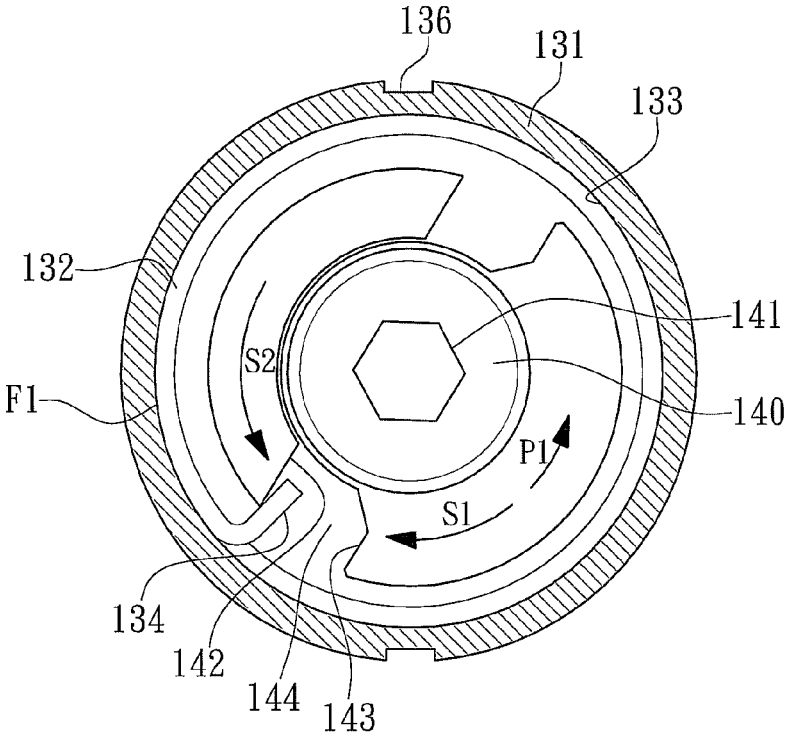
FIG. 7A to FIG. 7C are the cross-sectional views illustrating the rotations of the braking cushion mechanism of the blind cord winder during lifting, when stop, and during lowering the cordless blind according to the preferred embodiment of the present invention.
Figure 7B:
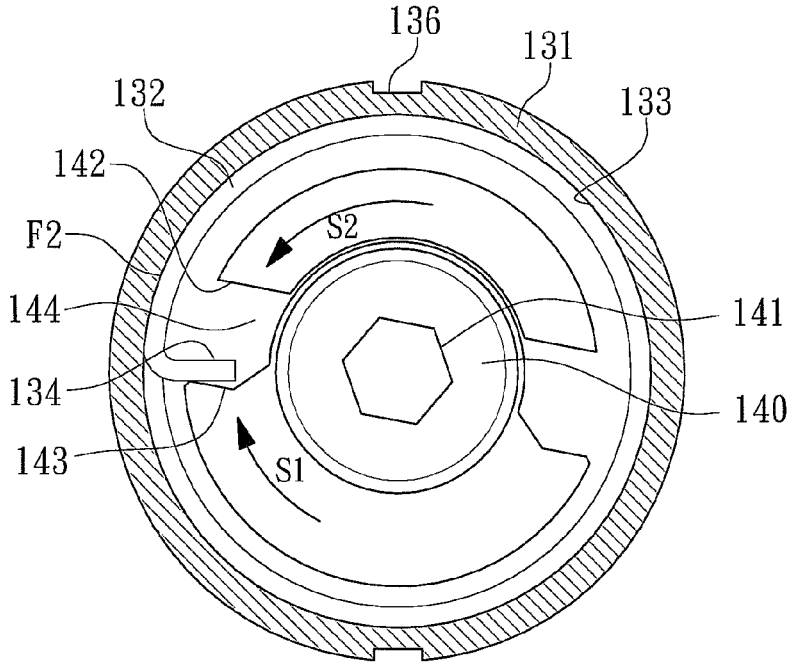
Figure 7C:
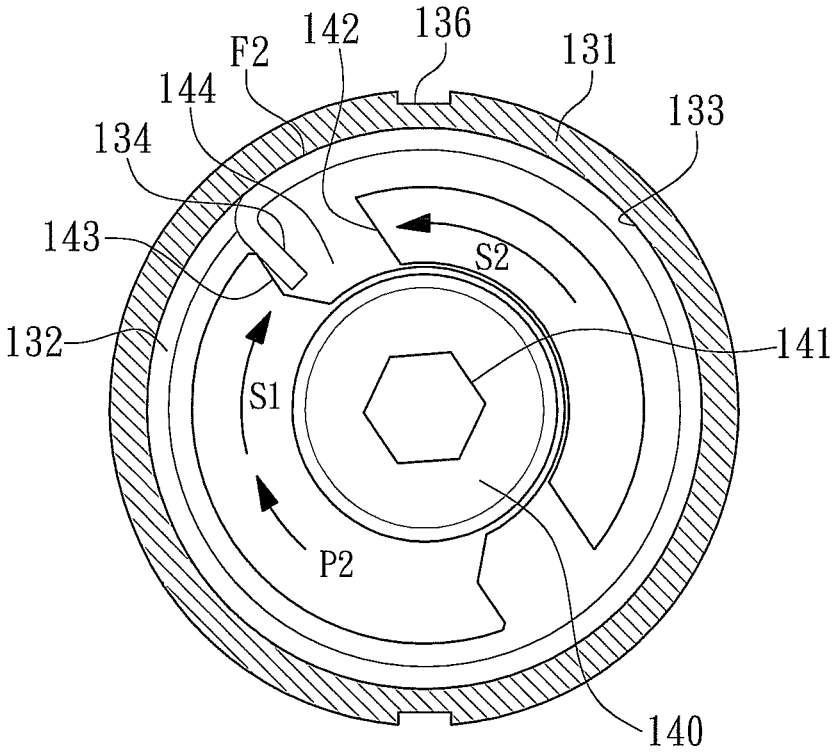

In the afore described blind cord winder 100, the trigger sleeve 140 is composed of a first separating part 171 and a second separating part 172 where the first separating part 171 has a trigger part 142 and the second separating part 172 has a stopping part 143. The second shaft jointing hole 141 of the trigger sleeve 140 can be disposed at the first separating part 171 or/and at the second separating part 172 depending on different needs. The extruded end 134 of the friction spring 132 is located in a gap 144 between the trigger part 142 and the stopping part 143 as shown in FIG. 7A to FIG. 7C. The trigger part 142 and the stopping part 143 are assembled with the friction spring 132 in a specific way so that the friction between the friction spring 132 and the friction ring 131 is reduced when the trigger part 142 contacts with the extruded end 134. In the present embodiment, the stopping part 143 and the trigger part 142 can be two corresponding side walls of two separated extruded arcs. To be more specific, the extruded end 134 of the friction spring 132 is extruded toward the axis of the friction spring 132, and the trigger part 142 and the stopping part 143 are plugged into the friction spring 132.

In a various embodiment, the trigger sleeve 140 can be formed in one body having a trigger part 142 and a stopping part 143 where the extruded end 134 is located in a gap 144 between the trigger part 142 and the stopping part 143. The trigger part 142 and the stopping part 143 are assembled with the friction spring 132 in a specific way so that the friction between the friction spring 132 and the friction ring 131 is reduced when the trigger part 142 contacts with the extruded end 134.

The blind cord winder 100 can lift and open the blind 10 due to the action of force-feedback mechanism 120. As shown in FIG. 7A, when the extruded end 134 contacts with the counterclockwise spiral part of the friction spring 132, the trigger part 142 is located at the clockwise side of the extruded end 134 and the stopping part 143 is located at the counterclockwise side of the extruded end 134. When the trigger part 142 contacts with the extruded end 134, the friction spring 132 is stretched which would slightly increase the number of coils, i.e., the diameter of the friction spring 132 would slightly be decreased to reduce the friction between the friction spring 132 and the friction ring 131 as the reduced friction F1 shown in FIG. 7A where the required counterclockwise rotation force of the trigger part 142 can be reduced. On the contrary, when the stopping part 143 contacts with the extruded end 134, the friction spring 132 is pushed to increase its diameter, however, the friction ring 131 confines the maximum diameter of the friction spring 132 so that the friction between the friction spring 132 and the friction ring 131 would be the same or slightly larger as the preset friction F2 shown in FIG. 7B and FIG. 7C. Therefore, the clockwise rotation of the stopping part 143 has to overcome the preset friction between the friction spring 132 and the friction ring 131, or the trigger sleeve 140 will not rotate.

As shown in FIG. 7A, when a user is exerted a lifting force P1 to the blind 10, once the reposition elastic force S2 from the volute spring 122 is greater than the gravity S1 of the cordless blind 10 minus the lifting force P1 from the user, i.e., S2>(S1−P1), the trigger part 142 of the trigger sleeve 140 would contact with the extruded end 134 of the friction spring 132 so that the number of coils of the friction spring 132 would slightly increase where the diameter of the friction spring 132 relatively becomes smaller. Thus, the friction between the friction spring 132 and the friction ring 131 obviously becomes smaller where this reduced friction F1 is nearly zero as shown in FIG. 7A. By keeping the friction ring 131 immovable, the trigger sleeve 140 and the friction spring 132 would vertically counterclockwise rotate to drive the blind shaft 180 and the spool 110 to roll up the blind cord 12 so that the cordless blind 10 can easily be lifted with minimum forces where the final equation to lift the cordless blind 10 is S2>(S1−P1)+F1. When the lifting force P1 exerted by a user become smaller, the equation will become S2≤(S1−P1)+F1 where the cordless blind 10 is able to stop at any positions during lifting the cordless blind 10.

As shown in FIG. 7B, when a user would like to stop the cordless blind 10 at any position without any exerted forces, normally the gravity S1 of the cordless blind 10 will be slightly greater than the reposition elastic force S2 from the volute spring 122, i.e., S1>S2, to make the trigger sleeve 140 to vertically clockwise rotate, however, the stopping part 143 of the trigger sleeve 140 will contact with the extruded end 134 of the friction spring 132 so that the number of coils of the friction spring 132 is the same or the friction spring 132 expands and becomes larger. Thus, the friction between the friction spring 132 and the friction ring 131 can be maintained at the preset value as the original friction F2 shown in FIG. 7B where F2>F1. When the cordless blind 10 has a different specification to make the gravity S1 of the cordless blind 10 be even larger, the original friction F2 can be increased due to the expansion of the friction spring 132 by contacting the stopping part 143 where the equation is S1≤S2+F2. Therefore, when the friction ring 131 and the friction spring 132 are not moving, the trigger sleeve 140 would not move, either, so that the cordless blind 10 is able to stop at any position.

Furthermore, as shown in FIG. 7C, when a user would like to lower the cordless blind 10 and exert a lowering force P2 to the cordless blind 10 where P2 is in the same direction as the gravity S1 of the cordless blind 10, moreover, the blind shaft 180, the spool 110, the shaft sleeve 121, and the trigger sleeve 140 are linking together. The vertically counterclockwise rotation of the shaft sleeve 121 and the trigger sleeve 140 is caused by the reposition elastic force S2 from the volute spring 122. Once the total forces of the gravity S1 of the cordless blind 10 plus the lowering force P2 from the user is greater than the total forces of the reposition elastic force S2 plus the original friction F2, i.e., (S1+P2)>(S2+F2), thus, the stopping part 143 of the trigger sleeve 140 would contact with the extruded end 134 of the friction spring 132 where the trigger sleeve 140 and the friction spring 132 still can vertically clockwise rotate to lower and close the cordless blind 10. When the lowering force P2 from a user becomes smaller until (S1+P2)≤(S2+F2), the cordless blind 10 is able to stop at any position during lowering.

The above description of embodiments of this invention is intended to be illustrative but not limited. Other embodiments of this invention will be obvious to those skilled in the art in view of the above disclosure which still will be covered by and within the scope of the present invention even with any modifications, equivalent variations, and adaptations.

What is claimed is:

1. A blind cord winder having stopping control, wherein an envelope of the blind cord winder consists of a first compartment and a second compartment jointed together, the blind cord winder comprising:

a spool installed inside the first compartment, wherein a shaft cavity is formed at a side of the first compartment;

a force-feedback mechanism installed inside the shaft cavity, the force-feedback mechanism including a shaft sleeve and a volute spring, wherein one end of the volute spring is connected to the shaft sleeve and the other end of the volute spring is fastened at the first compartment to provide a reposition elastic force for the shaft sleeve; and a braking cushion mechanism installed inside the second compartment, the braking cushion mechanism including a friction ring, a friction spring, and a trigger sleeve, wherein the friction ring with a wear-resistant annular inwall is immovably installed inside the second compartment, and the friction spring is tightly plugged into the wear-resistant annular inwall and has an extruded end for the trigger sleeve to trigger friction variation between the friction spring and the friction ring to have an adjustable fiction of the friction spring in a single directional rotation of the trigger sleeve when the trigger sleeve is in contact with an inner side of the extruded end along a spiral direction of the friction spring.

2. The blind cord winder as claimed in claim 1, further comprising a cover buckling to the other side of the first compartment to confine the spool inside the first compartment.

3. The blind cord winder as claimed in claim 1, wherein the braking cushion mechanism further includes a ring plug inserted in an opening end of the wear-proof annular inwall to prevent breaking away of the friction spring.

4. The blind cord winder as claimed in claim 1, wherein at least an alignment fillister is formed on an outer annular surface of the friction ring.

5. The blind cord winder as claimed in claim 1, further comprising a partition buckled to the side of the first compartment and located between the first compartment and the second compartment so that the shaft sleeve and the volute spring are confined inside the shaft cavity.

6. The blind cord winder as claimed in claim 5, wherein the second compartment is jointed to the partition to confine the trigger sleeve inside the second compartment.

7. The blind cord winder as claimed in claim 1, wherein the trigger sleeve is formed in one body having a trigger part and a stopping part, wherein the extruded end is disposed in a gap between the trigger part and the stopping part the stopping part, and the trigger part and the stopping part are assembled to fit in the friction spring so that the friction between the friction spring and the friction ring is reduced when the trigger part contacts with the extruded end.

8. The blind cord winder as claimed in claim 7, wherein the extruded end is extruded toward the axis of the friction spring and wherein the trigger part and the stopping part are plugged into the friction spring.

9. The blind cord winder as claimed in claim 1, wherein the trigger sleeve is composed of a first separating part and a second separating part, wherein the first separating part has a trigger part and the second separating part has a stopping part and the extruded end is located in a gap between the trigger part and the stopping part, wherein the trigger part and the stopping part are assembled to fit in the friction spring so that the friction between the friction spring and the friction ring is reduced when the trigger part contacts with the extruded end.

10. The blind cord winder as claimed in claim 9, wherein the stopping part and the trigger part are two corresponding side walls of two separated extruded arcs.

11. The blind cord winder as claimed in claim 9, the extruded end is extruded toward the axis of the friction spring and wherein the trigger part and the stopping part are plugged into the friction spring.

12. The blind cord winder as claimed in claim 1, wherein the shaft sleeve has a first shaft joint hole, and the trigger sleeve has a second shaft joint hole, wherein the first shaft joint hole and the second shaft joint hole are aligned in the same axis.

13. The blind cord winder as claimed in claim 12, wherein the spool has a third shaft jointing hole also aligned in the same axis.

14. The blind cord winder as claimed in claim 13, further comprising a blind shaft penetrating through the third shaft jointing hole of the spool, the first shaft jointing hole of the shaft sleeve, and the second shaft jointing hole of the trigger sleeve.

15. The blind cord winder as claimed in claim 14, further comprising a driving motor connecting to one end of the blind shaft.

* * * * *